US010858769B2

(12) United States Patent
James

(10) Patent No.: US 10,858,769 B2
(45) Date of Patent: Dec. 8, 2020

(54) SEWABLE FLANGE WITH SUPPORT RECEIVER

(71) Applicant: Timothy Richard James, Manitowoc, WI (US)

(72) Inventor: Timothy Richard James, Manitowoc, WI (US)

(73) Assignee: Timothy Richard James, Manitowoc, WI (US)

( * ) Notice: Subject to any disclaimer, the term of this patent is extended or adjusted under 35 U.S.C. 154(b) by 24 days.

(21) Appl. No.: 15/872,698

(22) Filed: Jan. 16, 2018

(65) Prior Publication Data

US 2018/0202089 A1 Jul. 19, 2018

Related U.S. Application Data

(60) Provisional application No. 62/446,402, filed on Jan. 14, 2017.

(51) Int. Cl.

| | |
|---|---|
| ***B63B 17/00*** | (2006.01) |
| ***D05B 35/10*** | (2006.01) |
| ***B63B 17/02*** | (2006.01) |

(52) U.S. Cl.

CPC ..... *D05B 35/10* (2013.01); *B63B 17/02* (2013.01)

(58) Field of Classification Search

CPC ..... B63B 17/02
USPC ..... 135/99, 119; 112/103
See application file for complete search history.

(56) References Cited

U.S. PATENT DOCUMENTS

| | | | | |
|---|---|---|---|---|
| 3,892,169 | A * | 7/1975 | Jarnot | B60H 1/26 454/275 |
| 4,184,414 | A * | 1/1980 | Jarnot | F24F 7/02 454/275 |
| 4,379,468 | A * | 4/1983 | Szukhent, Jr. | B63J 2/10 135/88.01 |
| 4,927,109 | A * | 5/1990 | Wilson | B63B 17/02 248/188.9 |
| 4,979,534 | A * | 12/1990 | Johnson | A45B 25/20 135/33.41 |
| 5,031,566 | A * | 7/1991 | Switzer | B63B 15/00 114/361 |
| 5,328,405 | A * | 7/1994 | Jarnot | B63J 2/10 454/275 |
| 6,938,631 | B2 * | 9/2005 | Gridley | B63J 2/04 135/114 |
| 6,939,219 | B1 * | 9/2005 | Pollen | B63J 2/04 114/211 |
| 7,347,159 | B1 * | 3/2008 | Thompson | B63B 17/02 114/361 |
| 8,069,870 | B2 * | 12/2011 | Gridley | B63J 2/04 135/135 |
| 10,064,441 | B1 * | 9/2018 | Provencher | A44B 17/0041 |
| 2014/0020799 | A1 * | 1/2014 | Gridley | B60J 11/00 150/166 |

* cited by examiner

*Primary Examiner* — Joshua T Kennedy

(57) ABSTRACT

A flexible support receiver comprising a base, a sewing flange, and a snap fit flange. The base is configured to receive one or more support poles or other support device. A first sewing flange and a second sewing flange are radially disposed around the perimeter of the base. The support receiver may contain vented openings. A sewing fixture aids to position hardware with a circular sewing flange such that a sewing machine places a circular stitch line relative to the central axis of the hardware.

10 Claims, 13 Drawing Sheets

SEWABLE FLANGE WITH SUPPORT RECEIVER

PRIORITY

The present application is a non-provisional application claiming priority to Provisional Application Ser. No. 62/446,402, filed on Jan. 14, 2017, the disclosure of which is incorporated herein by reference. Since the one year anniversary of this provisional filing fell on a Sunday, Jan. 14, 2018, followed by a US federal holiday on Monday, Jan. 15, 2018, this application may be filed no later than Tuesday, Jan. 16, 2018, while still preserving the priority claim.

BACKGROUND

It is well known to use large weather-resistant covers for a variety of vehicles or watercraft in a number of industries. Often, these covers need to be supported over the underlying vehicle or watercraft and finding ways to support the covers from underneath or from above has challenged these industries for decades. One of the problems to be solved is how to securely and durably engage these underlying supports without causing damage to the cover material. Various hardware components have been devised to overcome these challenges. Various methods to attach these hardware components are employed. Methods to attach hardware to fabric or other flexible materials may include welding, mechanical fastening, crimping, sewing or gluing. Large coverings present many challenges for installing hardware. Access to the perimeter of the covering is simple for installing hardware. Many installation methods work well in this situation due to the ease of presenting a tool such as a sewing machine, welder, fixture or crimping press to the cover. Installing hardware in the center of a large covering can be difficult. A sewing machine typically has an arm less than 20", leaving little space for moving a large covering. Long arm sewing machines are expensive and are not commonly used in smaller industrial sewing businesses.

Covering supports are frequently located in the center of large panels. Many coverings may have reinforcing sewn in areas where a support is located. The support may be held in place by a snap, webbing or other hardware to secure the support in place relative to the covering.

In order to place hardware in the center of a panel, many hardware components for coverings rely on mechanical fastening to secure the hardware in place due to the challenges with using a tool such as a sewing machine in this area.

In order for a mechanically fastened hardware component to work in these applications, the securing hardware must be manufactured from rigid materials. Screw threads, holes and bosses allow these multi-part assemblies to bolt, screw, crimp or clamp to the covering. Mechanically fastening a rigid component to a flexible material requires local reinforcing to prevent hardware from wearing through the covering.

Although fabrication fixtures that allow relative motion between a work piece and a tool are present in other industries such as woodworking and metal, it is difficult to address circular sewing operations in the middle of a large workpiece.

These hardware components have multiple drawbacks. Multiple components in the mechanically fastened assembly add cost and complexity to the manufacturing process. Clamping methods reduce the strength of the covering. Rigid attachments create wear points when the fabric is not aligned with the attachment. Fasteners point load the fabric. Rigid components break when dropped or hit and may crack at low temperatures. Local reinforcing that is added at the installation point adds cost.

Improvements on the prior are desirable to overcome these and other limitations.

SUMMARY

While the prior art provides for various cover insert hardware, no design of the prior art includes all of the features of the present disclosure. The present disclosure overcomes the limitations of the prior art by providing a hardware component which may be manufactured as a single, elastomeric, molded component. Such a design overcomes the limitations of the prior art by providing a durable design that is flexible, aligns with loads, distributes load about the hardware and installs easily. By doing so, this design does not cause excess wear on the cover material attached to the cap.

Additionally, the design of the present disclosure is unique because it overcomes the challenges associated with sewing support receivers onto large covers. Sewing a flange onto a large cover is difficult due to several reasons. Cover supports are typically located in the center of the cover where it is the most difficult to sew. Aligning hardware on large covers is difficult due to the inability of an operator to see through the hardware component while sewing. Rotating a part while sewing requires constant realigning of parts. This design solves this manufacturing problem by way of a snap flange designed into the part that that fixes the material in place during the assembly process.

Although typically manufactured as a one-piece unit, the support receiver can be described as comprising three main parts: a central boss which can be configured to accept a support, a sewing flange, and a snap flange. The flange may contain a plurality of external and internal supporting ribs.

BRIEF DESCRIPTION OF THE DRAWINGS

The accompanying drawings, which are included to provide further understanding of the disclosure and are incorporated in and constitute a part of this specification illustrate embodiments of the disclosure, and together with the description, serve to explain the principles of the disclosure.

In the Drawings.

DETAILED DESCRIPTION

Reference will now be made in detail to the embodiments of the present disclosure, examples of which are illustrated in the accompanying drawings. Wherever possible, the same reference numbers will be used throughout the specification to refer to the same or like parts.

The present disclosure provides for a support receiver design manufactured as one piece from one or more elastomeric materials. One embodiment containing vented openings of such a support receiver and associated installation hardware is illustrated by FIG. 1-FIG. 8. The present disclosure focuses on an embodiment in which the support receiver is affixed to a covering via sewing. However, it is possible that the support receiver may also be affixed to a covering via adhesive, welding or mechanical fastening as provided in the prior art.

Figure 1:
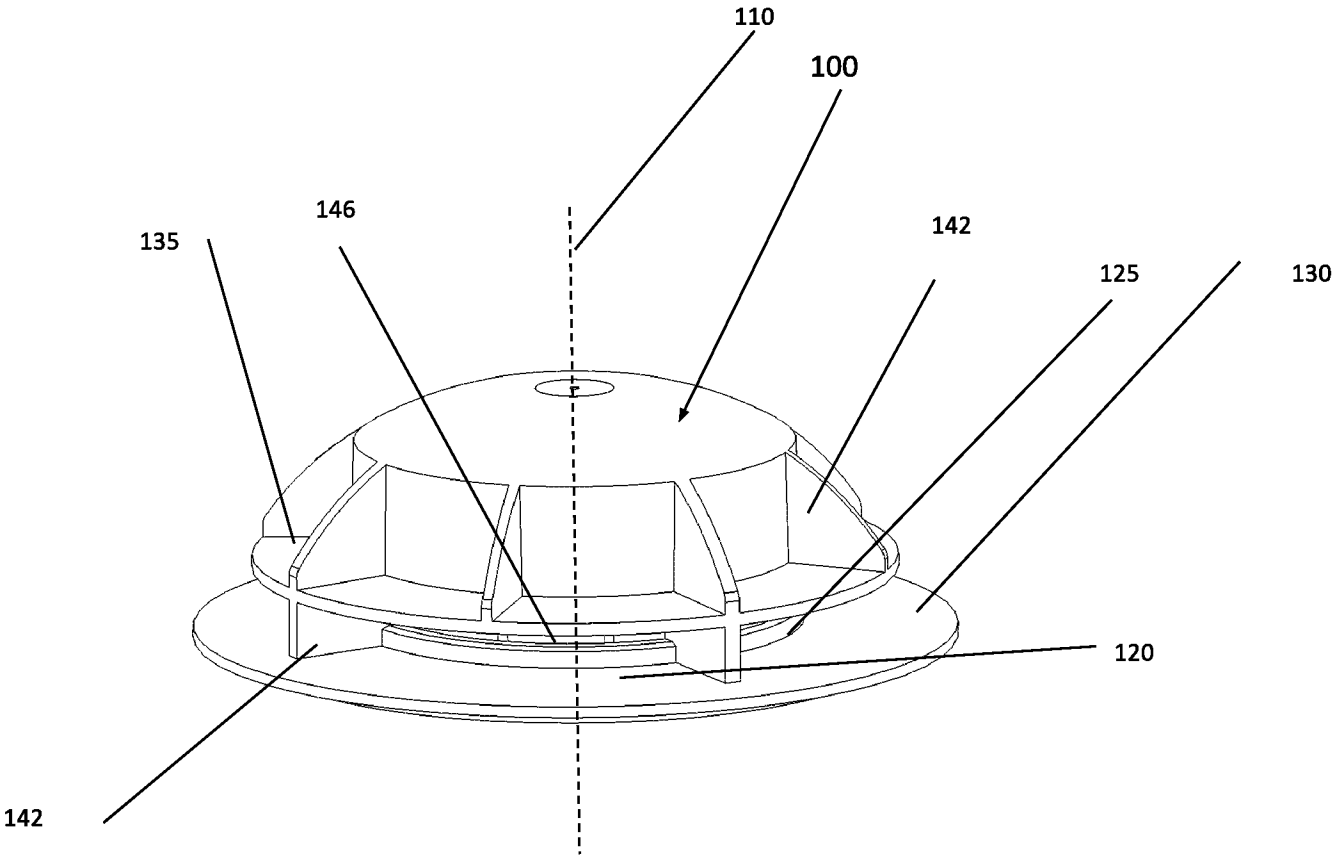
FIG. 1 is an isometric top view of a first embodiment of a support receiver according to the present disclosure containing vented openings.
Figure 2:
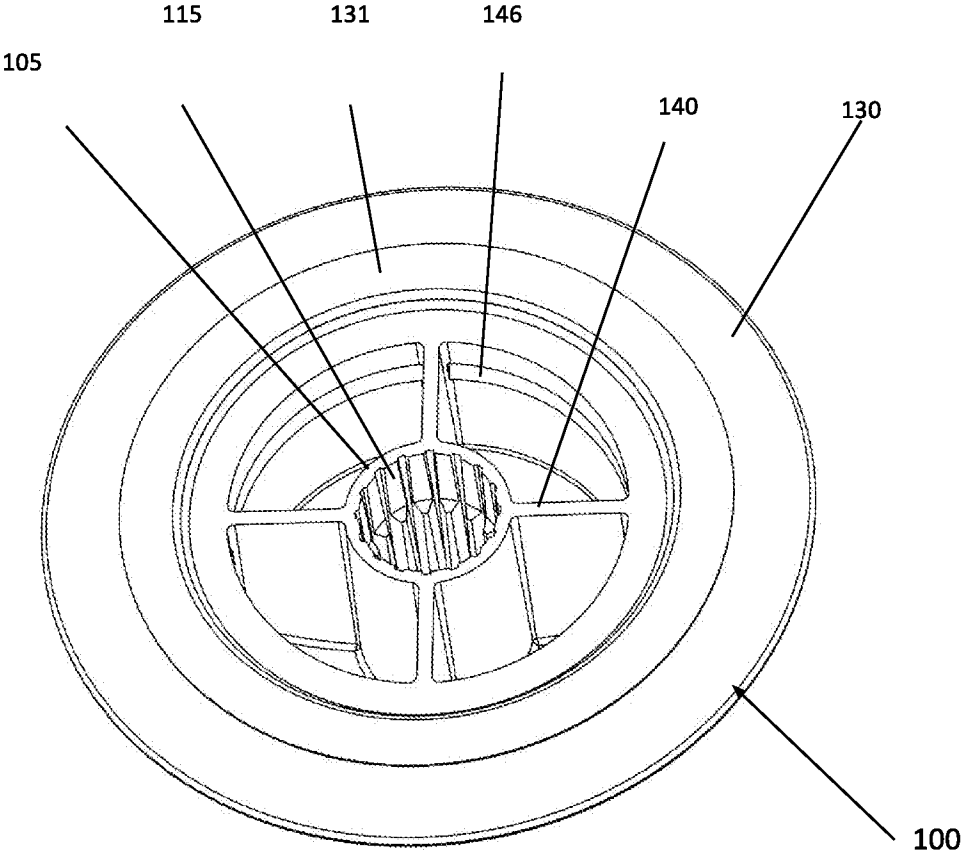
FIG. 2 is an isometric bottom view of the support receiver of FIG. 1.

Referring to FIG. 1 and FIG. 2, a support receiver 100 may include a hollow boss 105 forming a central axis 110 of the support receiver 100. The hollow boss 105 may be configured to receive one or more support poles (not illustrated) of an underlying support structure that may be used to position a flexible cover including one or more support receivers 100 over an object to be protected. Such objects to be protected by include but are not limited to boats, cars, trucks, pools, and other similar objects. Hollow boss 105 may further include a plurality of grooves 115. These grooves 115 create an interference fit between the hollow boss 105 and a support pole. In one embodiment, the grooves 115 may be vertical ridges that enable an interference fit between the hollow boss and support poles of different diameters. An interference fit is a method for fastening various component parts by friction rather than by other means. This fit works well in this application due to the elastomeric material. To enable a fit with support poles of different diameters, the hollow boss 105 may include multiple steps in diameter, have a tapered design, and/or may include crush ribs to enable a secure fit with the support pole. The grooves 115 may be arranged radially around the central axis 110.

The support receiver 100 may include a base 120 concentric to the central axis 110 of the hollow boss 105. The base 120 may further include a ridge 125 configured to prevent water and other materials from entering the support receiver 100. A first sewing flange 130 having a first diameter 130 and a second snap fit flange having a second diameter 131 may be radially disposed around the perimeter of the hollow boss 105. In one embodiment, the snap fit flange 131 may be located on the underside of the first sewing flange 130. The addition of the snap fit flange 131 overcomes the limitations of the prior art with respect to an operator not being able to see through the support receiver 100. This transition point, between the support receiver and the covering material, may be soft and should not pierce, abrade, or excessively wear the fabric. The flexibility of the sewing flange 130 also helps to prevent premature wear at this transition point.

The support receiver 100 may further include a cap 135. The cap 135 may include a plurality of external supporting ribs 142 and internal supporting ribs 140. The internal supporting ribs 140 may be operably coupled to the base 120 to thereby form a vent opening 146 between the cap 135 and the base 120. The external supporting ribs 142 may be coupled to the bottom of the cap. These supporting ribs 140 and 142 distribute the weight and stress from the central hollow boss 105 over the support receiver 100, to the perimeter of the base 120, and to the fabric. The weight and stress put on the support receiver by the support pole is thereby distributed to over a large area. Such a design is beneficial over designs of the prior art that do not use support ribs or similar structures and provides for stronger, more durable coverings.

In one embodiment 100, illustrated by FIG. 2, support ribs 140 may be configured so as to create a plurality of passages through the vent opening 146. FIG. 2 shows support ribs 140 creating four passages through the vent opening 146, although the present disclosure contemplates any number of passages may be constructed. These additional support ribs 140 provide structural support to the support receiver and also further prevent water and other materials from entering the support receiver. The passages are covered by the vent cap 135 and ridge 125 (not visible) to further prevent water and other materials from entering the support receiver.

Figure 3:
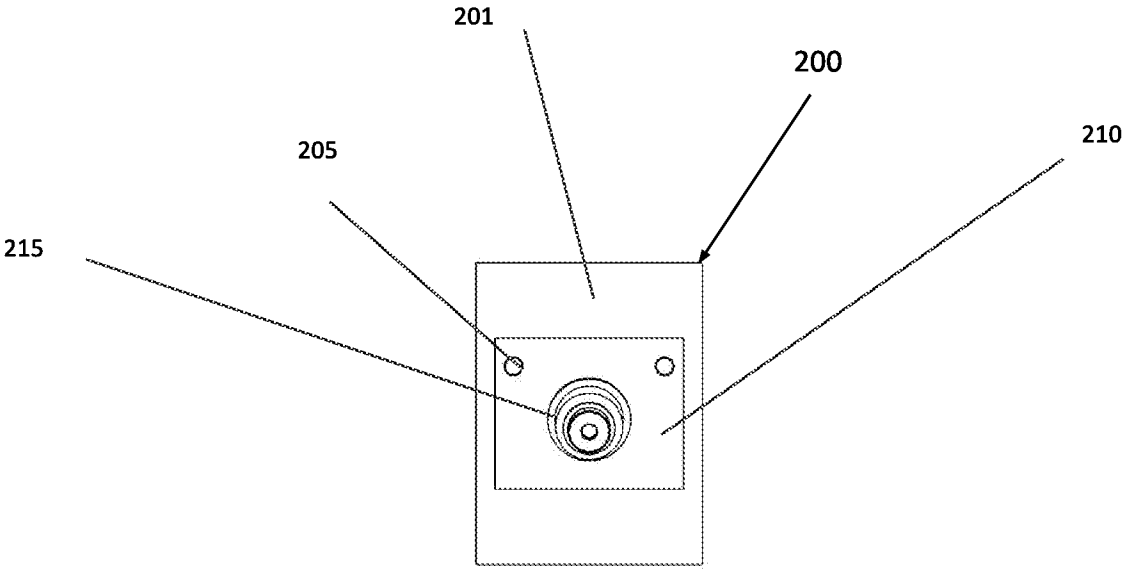
FIG. 3 is top view of a manufacturing fixture for use with a support receiver according to the present disclosure.
Figure 4:
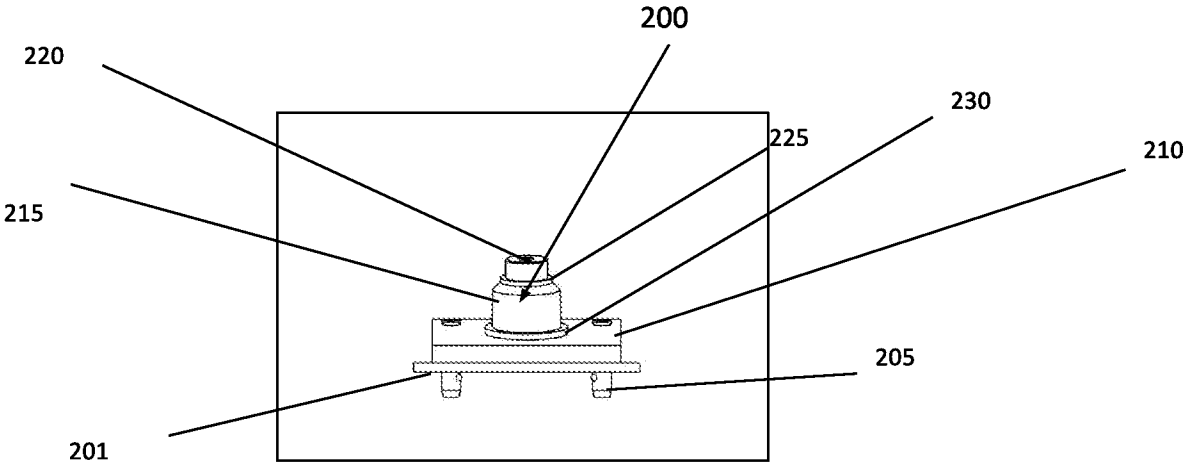
FIG. 4 is side view of the manufacturing fixture of FIG. 3.

FIG. 3-4 illustrates top and side projected views of a sewing machine fixture 200 that may be detachably coupled to a sewing machine base 201. This embodiment of the sewing machine fixture utilizes quick release pins 205 to attach the fixture base 210 to the sewing machine base 201. A rotatable hub 215 is attached to the fixture base by means of a bearing 225 and axle 220. The hub may optionally contain a projection 230 to allow for accurate engagement of the hub 215 and the hollow boss 105.

Figure 5:
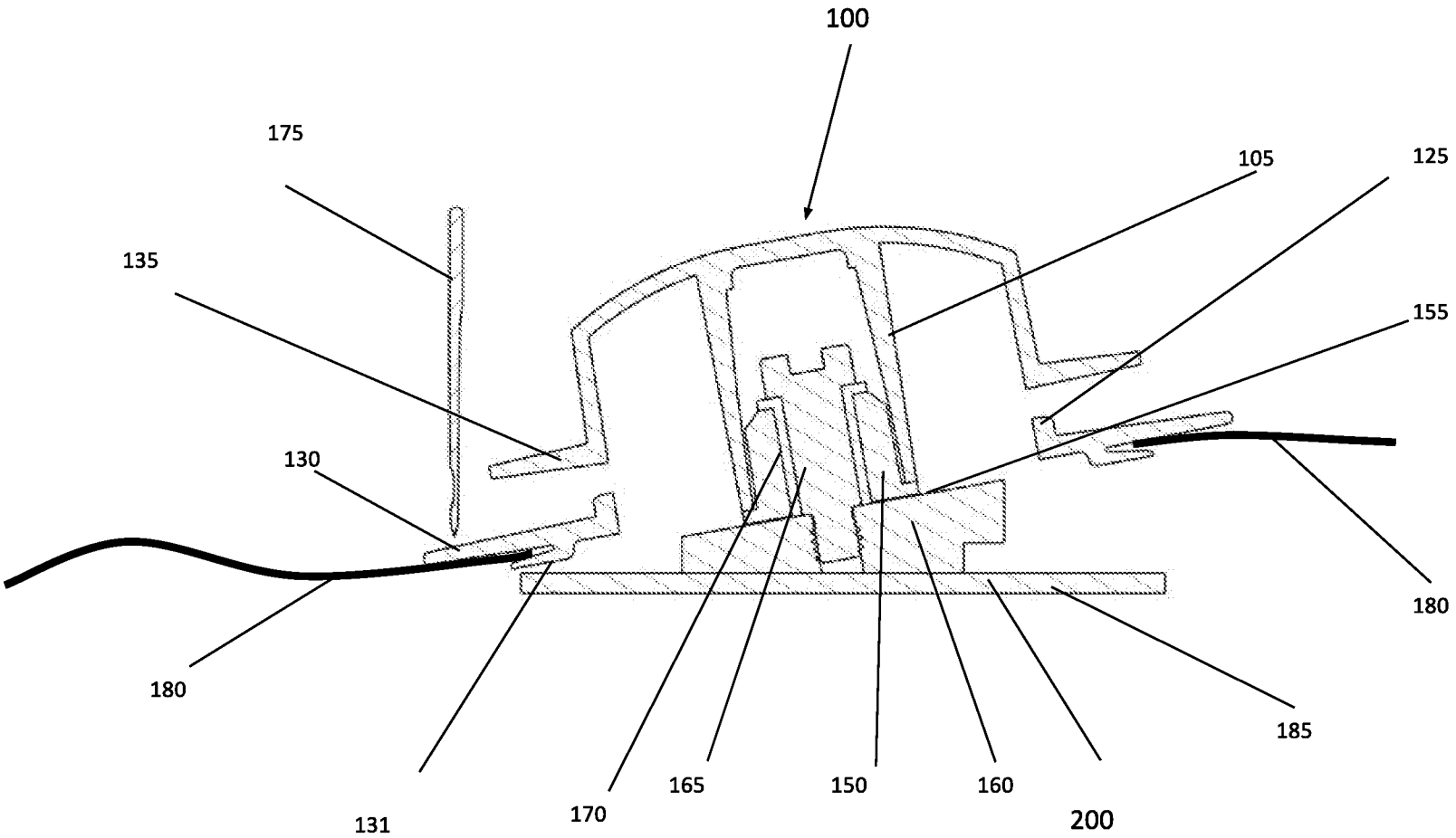
FIG. 5 is a section view of the of the support receiver of FIG. 1 detachably coupled to the manufacturing fixture of FIG. 3.

FIG. 5 illustrates additional component parts that enable the sewable support receiver design disclosed herein. The covering fabric may be prepared by cutting an opening in the fabric concentric to the diameter of the sewing flange 130 and sized to fit the internal diameter of the snap fit flange 131. The fabric may be temporarily secured into place by stretching the opening over the snap fit flange 131. The snap fit flange 131 may also cover the raw edge of the fabric, providing for a smooth and finished end product. The hollow boss 105 may then optionally placed on to sewing fixture 200 which includes a hub 150, a fixture base 160, an axle 165, and a bearing 170. A projection 155 in the hub 150 fixes the support receiver 100 in the proper position on the sewing fixture with respect to the needle 175. The sewing fixture enables the support receiver 100 to freely rotate during sewing by the feed mechanism of the machine, producing a stitch line perfectly concentric to the sewing flange 130. The fixture base 160 may be affixed to the sewing machine base 185 by any means known in the art including but not limited to a slide out plate or quick release pins. Alternatively, the support receiver can be attached without the sewing fixture to a covering using the cap 135 as needle guide to hand sew about the perimeter.

Figure 6:
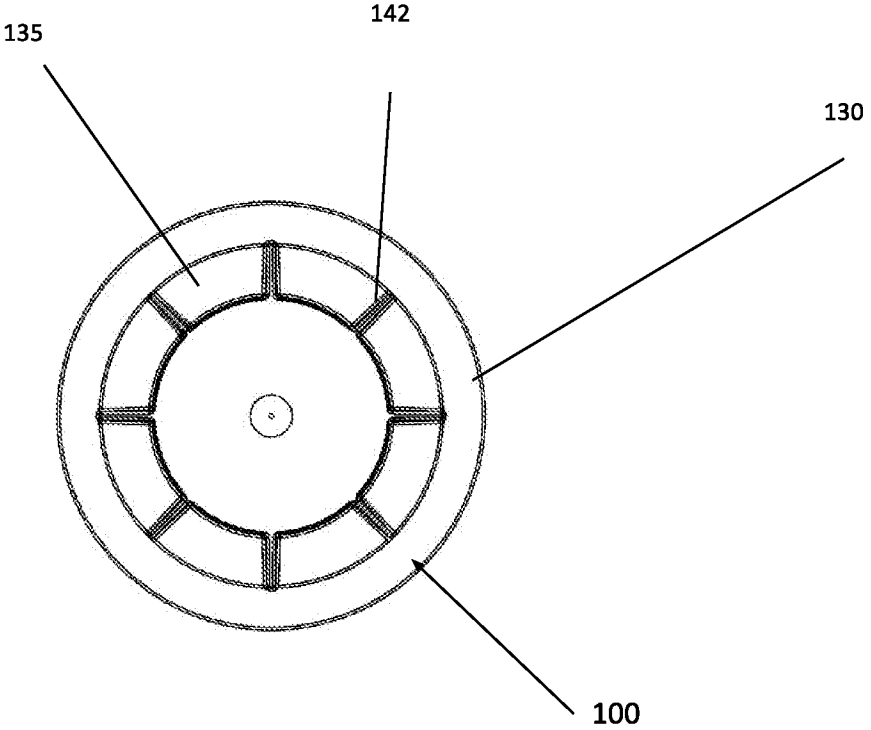
FIG. 6 is a top view of the of the support receiver of FIG. 1.
Figure 7:
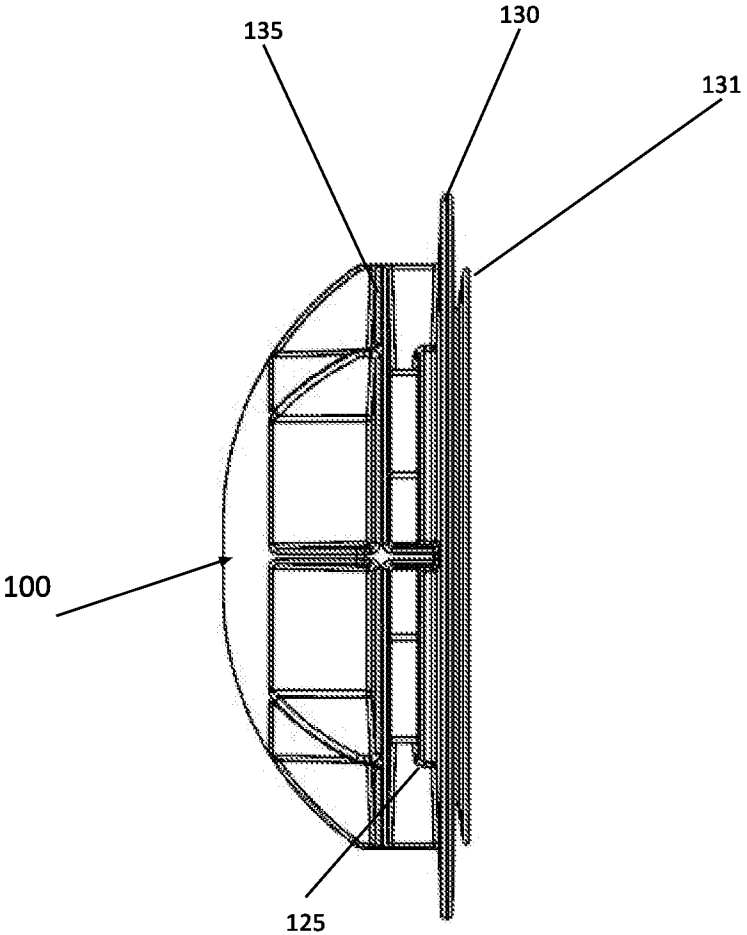
FIG. 7 is a side view of the of the support receiver of FIG. 1.
Figure 8:
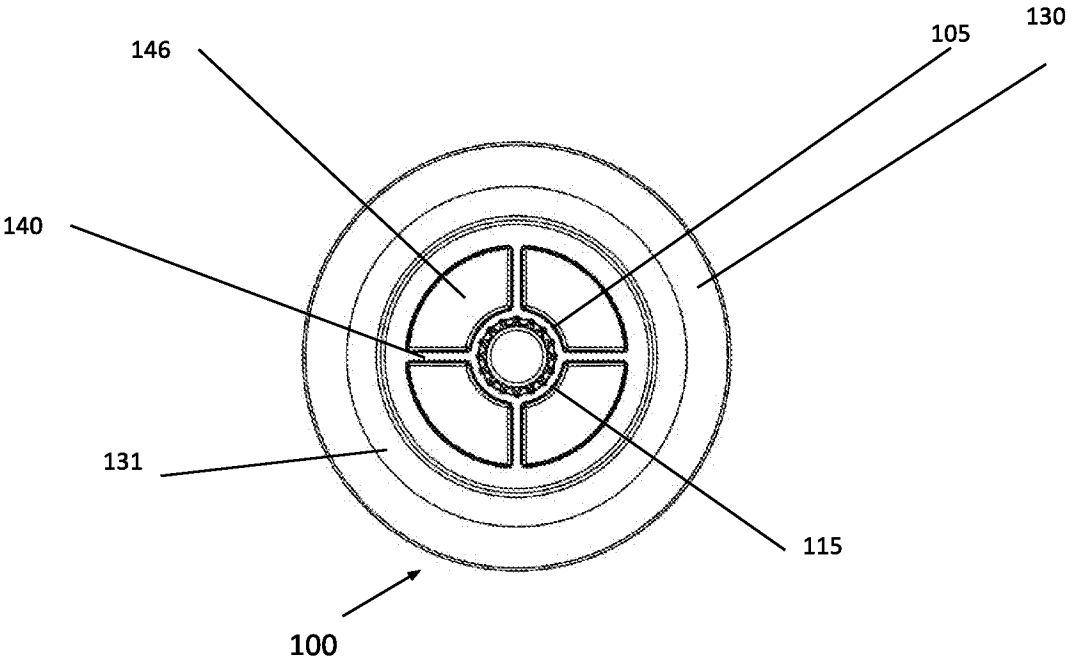
FIG. 8 is a bottom view of the of the support receiver of FIG. 1.
Figure 9:
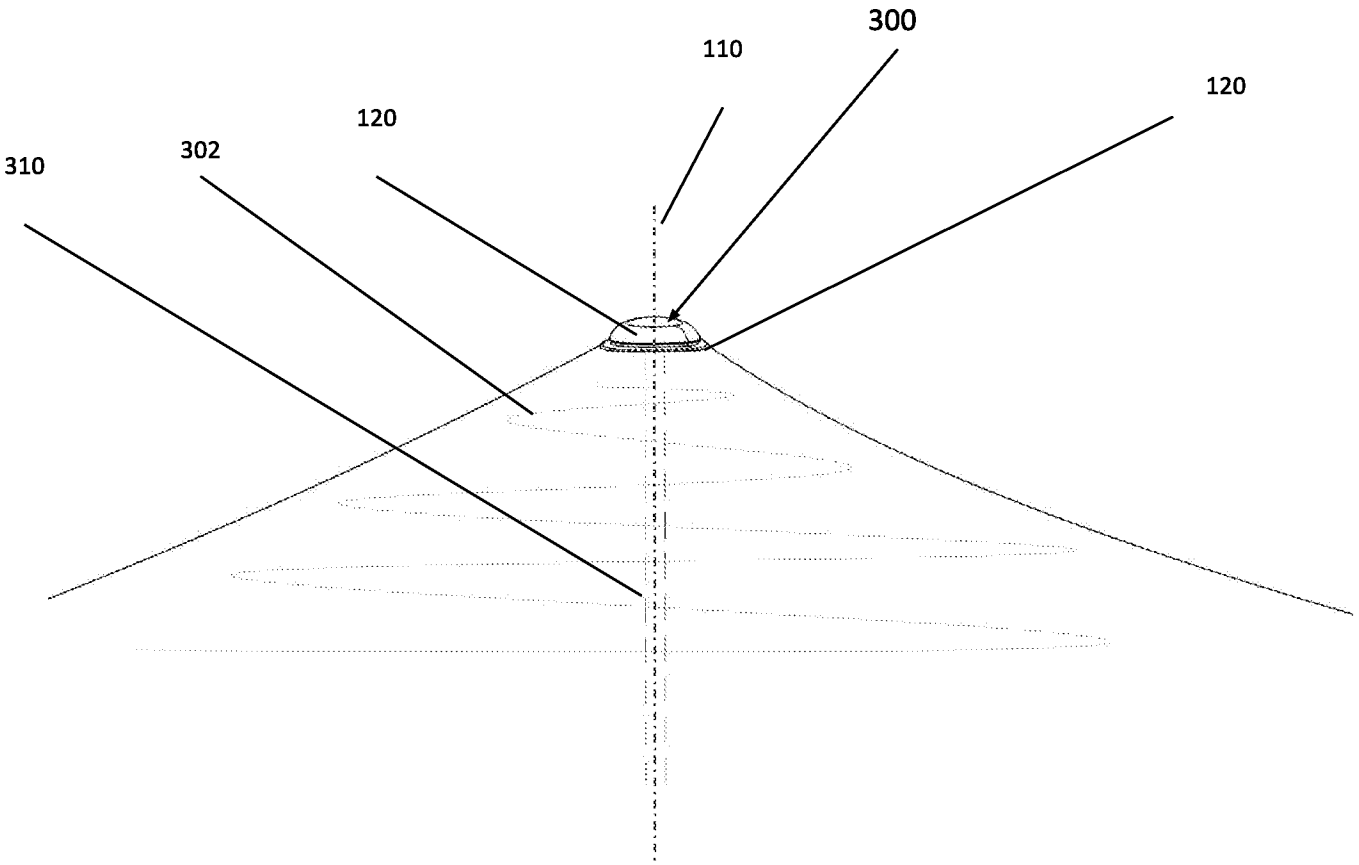
FIG. 9 is a side view of an alternative embodiment of a support receiver according to the present disclosure attached to a covering, in a loaded state and detachably coupled to an internal support.
Figure 10:
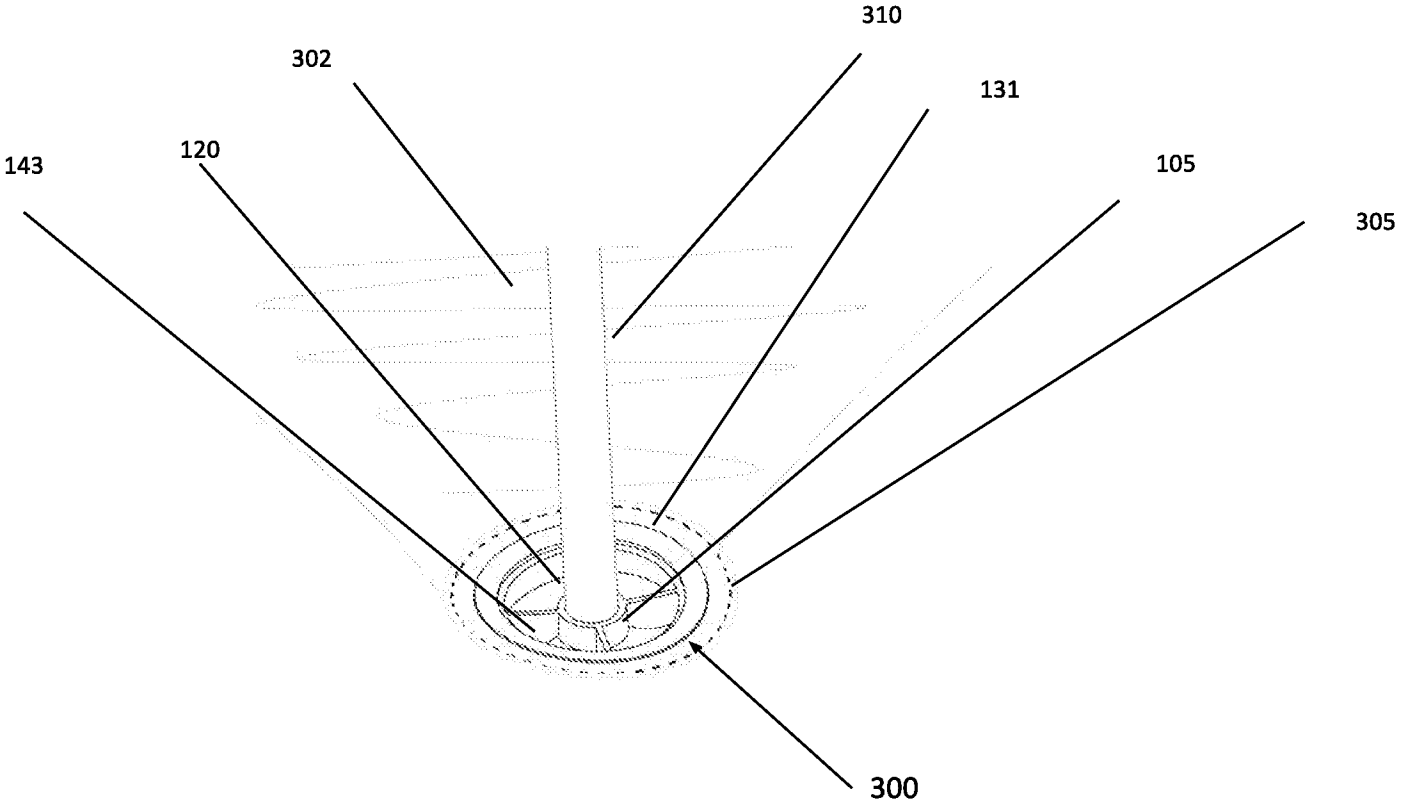
FIG. 10 is an isometric bottom view of the support receiver of FIG. 9, detachably coupled to an internal support.
Figure 11:
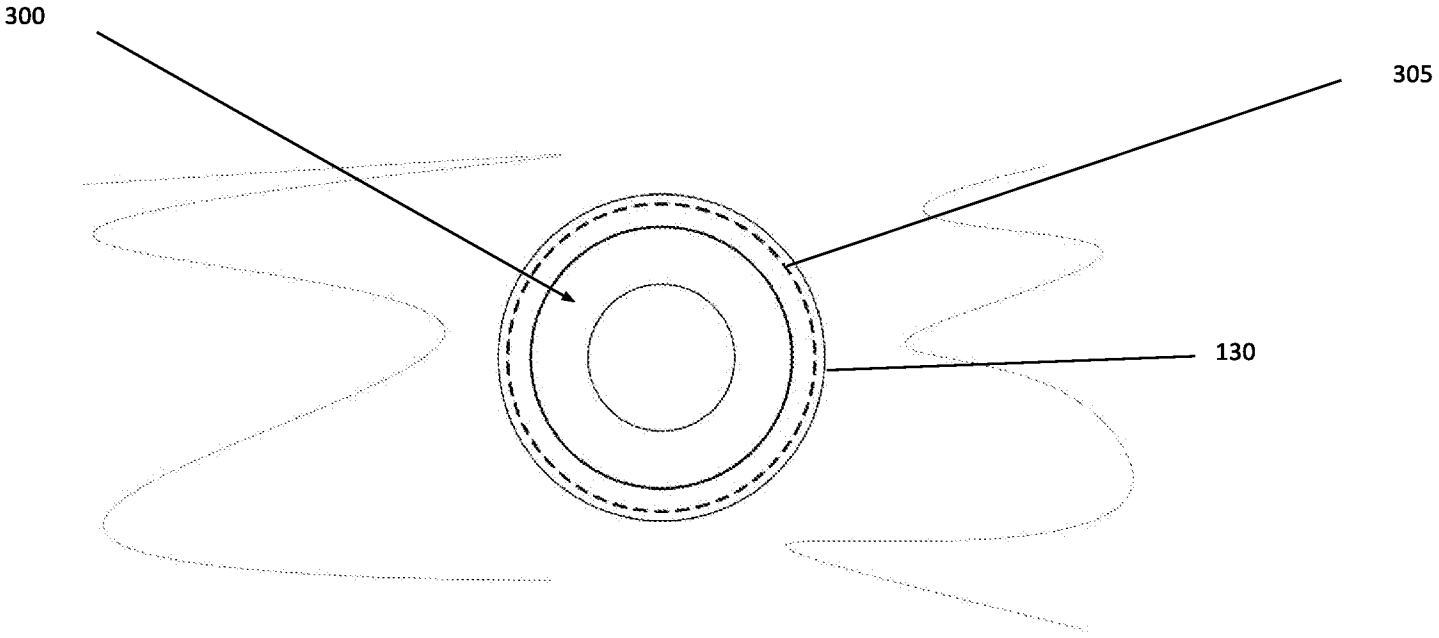
FIG. 11 is a top view of the support receiver of FIG. 9, attached to a covering.

FIGS. 6-8 illustrate additional views of the support receiver 100 and provide exemplary specifications of this embodiment of the present disclosure. The dimensions and measurements of FIG. 4 are illustrative and not intended to limit the potential embodiments of the support receiver disclosed herein. The various views of FIGS. 6-8 illustrate not only the potential internal relationship of the various component parts but also a possible finished look of the support receiver. Like FIG. 2, the embodiment of FIGS. 6-8 includes a vent opening with four passages created by the internal supporting ribs and a ridge configured to prevent water and other materials from entering the support receiver itself. The support receiver may also include multiple flanges to enable the support receiver to be easily sewn onto the marine cover fabric.

Another embodiment 300 of a support receiver according to the present disclosure without vent openings is illustrated by FIG. 9-FIG. 12. The present disclosure focuses on an embodiment in which the receiver is constructed of an elastomeric polyurethane material, although the present disclosure contemplates that any number of alternative suitable materials using various durometers may be constructed provided they provide the characteristics described herein Referring to FIG. 9 and FIG. 10, the support receiver 300 is shown in situ with a load applied. Support receiver 300 is configured similarly to support receiver 100, above, with the primary difference being a lack of vent openings. A flexible covering 302 is connected to the sewing flange 130 of support receiver 300 by means of stitching 305. Applying a load with an internal support 310 to the flexible covering 302 deforms the sewing flange 130 such that the load is distributed to the sewing flange 130 and the sewing flange 130 deforms until the covering 302 and sewing flange 130 are parallel. In this embodiment, the base 120 may be include a hollow boss 105, forming a central axis 110 of the support receiver 300. The hollow boss 105 may be configured to receive one or more detachably coupled support poles 310. A sewing flange 130 is radially disposed about the central axis and provides space to attach the support receiver to a covering.

Figure 12:
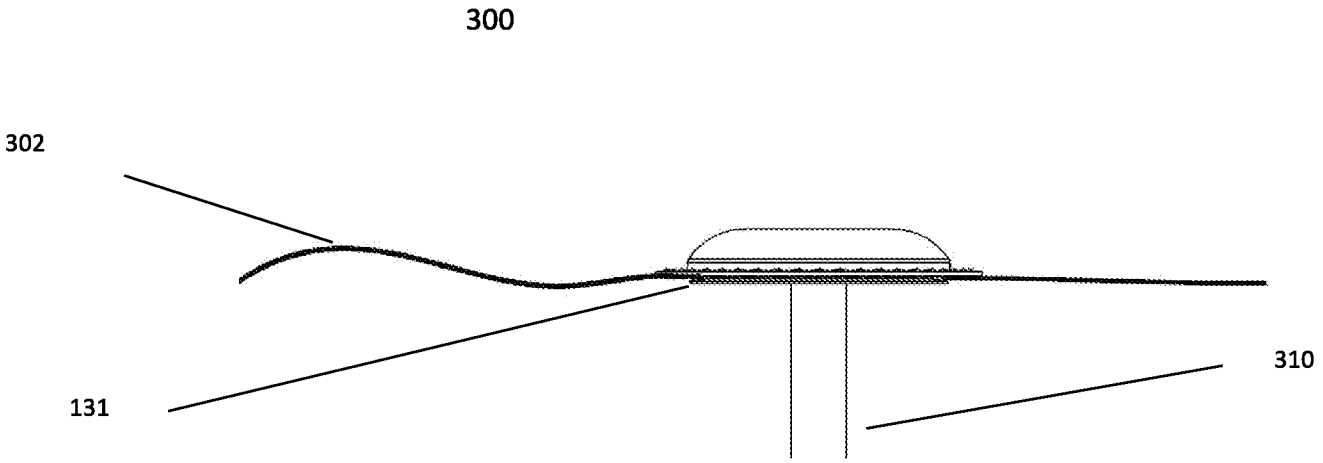
FIG. 12 is a side view of the support receiver of FIG. 9, attached to a covering and detachably coupled to an internal support.

Referring to FIG. 12, the support receiver 300 is shown with no load applied. A snap fit flange 131 fixes the support receiver 300 relative to the covering 302 in place during manufacturing.

Figure 13:
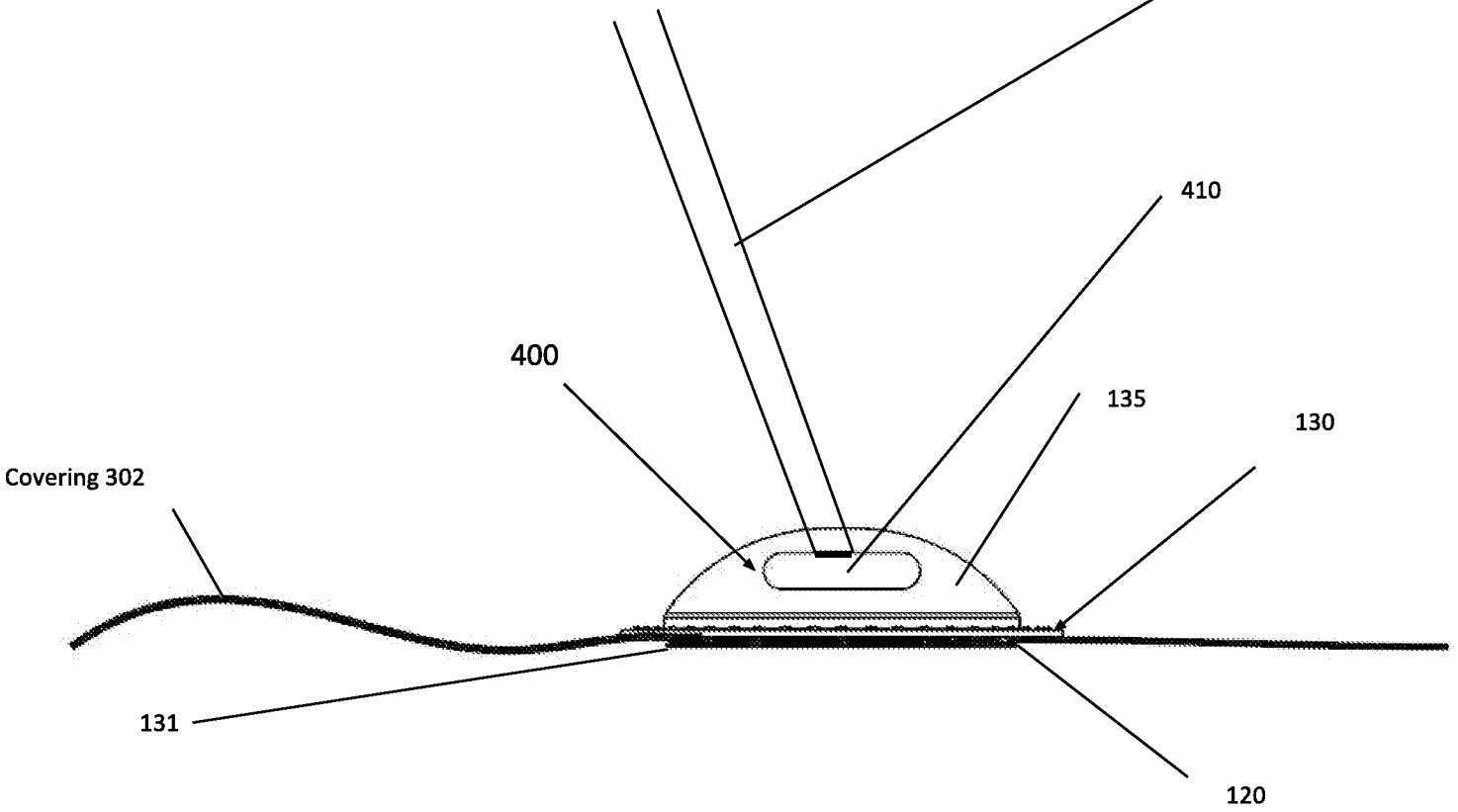
FIG. 13 is a side view of second alternative embodiment of a support receiver according to the present disclosure with an external tension support.

Referring to FIG. 13, the support receiver 400 is shown with no load applied. An opening is provided for attaching an external tension support 415. A snap fit flange 131 fixes the support receiver 300 relative to the covering 302 in place during manufacturing. While FIG. 13 shows a webbing strap as the tension support, it is anticipated that any other suitable tension member may engage support receiver 400.

While the disclosure has been described in detail in reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A monolithic support receiver attached to a flexible cover material comprising:

a sewing flange having a first diameter;

a base configured to receive a load bearing device;

a snap fit flange having a second diameter and being spaced from said sewing flange to define a groove there between;

wherein the second diameter is smaller than said first diameter such that the receiver is configured to snap into a hole in the flexible cover material; and wherein the sewing flange is positioned such that the flexible covering material is positioned between the sewing flange and the snap fit flange in the groove and the flexible covering material is further attached to the sewing flange by sewing through the sewing flange and the flexible cover material.

2. The support receiver of claim 1, further comprising the support receiver being made of an elastomeric material.

3. The support receiver of claim 2, further comprising the support receiver being made of a plurality of elastomeric materials with different levels of flexibility.

4. The support receiver of claim 1, further comprising a vent opening adjacent to the sewing flange allowing air within the cover to move to the outside.

5. The support receiver of claim 4, wherein said vent is divided into a plurality of passages by a plurality of interior supporting ribs.

6. A monolithic support receiver comprising:

a sewing flange having a first diameter;

a cap having an open base configured to receive a load bearing member and an opening on the opposite side of the open base configured for attaching an external tension support;

a snap fit flange having a second diameter and being spaced from said sewing flange to define a groove there between;

wherein the second diameter is smaller than the first diameter such that the receiver is configured to snap into a hole in a flexible cover material; and wherein the support receiver is configured to be further attached to the flexible cover material by sewing through the sewing flange and the flexible cover material.

7. A monolithic vented support receiver comprising:

a sewing flange having a first diameter;

a base having an open base configured to receive a load bearing member;

a snap fit flange having a second diameter and being spaced from said sewing flange to define a groove there between;

wherein the second diameter is smaller than the first diameter such that the receiver is configured to snap into a hole in a flexible cover material; and wherein the support receiver is configured to be further attached to the flexible cover material by sewing through the sewing flange and the flexible cover material;

a cap over the base opposite the open base, the cap and the base cooperating to form a vent opening between the cap and the base to prevent water from entering the vent opening and passing through the support receiver.

8. The support receiver of claim 7, further comprising a plurality of grooves within a hollow boss configured to create an interference fit engagement between the hollow boss and the underlying support load bearing member.

9. The support receiver of claim 8, further comprising the plurality of grooves including tapered vertical ridges and a plurality of steps for engaging underlying support members of different diameters.

10. The support receiver of claim 8, further comprising a second plurality of grooves arranged radially about the central axis.

* * * * *